US006830238B1

(12) United States Patent
Kesselring

(10) Patent No.: US 6,830,238 B1
(45) Date of Patent: Dec. 14, 2004

(54) AIR BLEED CONTROL DEVICE FOR CARBURETORS

(75) Inventor: Stephen H. Kesselring, Dothan, AL (US)

(73) Assignee: Stephen H Kesselring, Dothan, AL (US)

( * ) Notice: Subject to any disclaimer, the term of this patent is extended or adjusted under 35 U.S.C. 154(b) by 0 days.

(21) Appl. No.: 10/653,684

(22) Filed: Sep. 2, 2003

Related U.S. Application Data

(63) Continuation of application No. 10/143,504, filed on May 10, 2002, now abandoned.
(60) Provisional application No. 60/289,867, filed on May 10, 2001.

(51) Int. Cl.[7] ..... F02M 13/02
(52) U.S. Cl. ..... 261/16; 261/23.2; 261/DIG. 1
(58) Field of Search ..... 261/16, 23.2, 51, 261/63, 121.3, 121.4, DIG. 1

(56) References Cited

U.S. PATENT DOCUMENTS 1,629,500 A * 5/1927 Good ..... 123/184.39
3,841,283 A * 10/1974 Wood ..... 123/676
3,857,908 A * 12/1974 Brown et al. ..... 261/39.2
3,899,551 A * 8/1975 Korte ..... 261/39.2
4,052,968 A * 10/1977 Hattori et al. ..... 123/676
4,065,920 A * 1/1978 Minami et al. ..... 60/276
4,103,657 A * 8/1978 Minami ..... 123/683
4,136,645 A * 1/1979 Ito et al. ..... 123/684
4,204,514 A * 5/1980 Ishida ..... 123/198 F
4,261,311 A * 4/1981 Rupe ..... 123/198 F
4,276,237 A * 6/1981 Barker et al. ..... 261/39.2
4,320,731 A * 3/1982 Braun et al. ..... 123/438
4,351,300 A * 9/1982 Selvidge et al. ..... 123/527
4,377,539 A * 3/1983 Irish et al. ..... 261/121.4
4,432,324 A * 2/1984 Ishikawa et al. ..... 123/438
4,446,834 A * 5/1984 Yoneda et al. ..... 123/699
4,473,510 A * 9/1984 Kato et al. ..... 261/39.2
4,479,108 A * 10/1984 Bookbinder ..... 340/439
4,530,805 A * 7/1985 Abbey ..... 261/53
4,532,904 A * 8/1985 Osawa et al. ..... 123/439
4,541,384 A * 9/1985 Nakazato ..... 123/437
4,768,494 A * 9/1988 Hale ..... 123/579
4,913,855 A * 4/1990 Panzica ..... 261/50.1
5,002,705 A * 3/1991 Kohler ..... 261/35
5,762,158 A * 6/1998 Sumner, Jr. ..... 180/219
6,003,844 A * 12/1999 Konagai et al. ..... 261/23.2

* cited by examiner

*Primary Examiner*—Richard L. Chiesa

(57) ABSTRACT

There is disclosed an internal combustion engine carburetor fuel/air circuit air bleed input control device having an air distribution block, at least one air input port and one or more air output ports connected with the air bleed inputs of one or more carburetors. A control valve is disposed between the air input and an air flow balance chamber to which the output ports are connected. Two valves and balance chambers can provide control for carburetors having two fuel/air circuits. Optionally, an input air tube may be provided so that the source of air for the air distribution block input or inputs may be located in selected locations, for example, in a carburetor air stream. Another option is to provide a remote control from, for example, the handlebars of a motorcycle.

6 Claims, 5 Drawing Sheets

AIR BLEED CONTROL DEVICE FOR CARBURETORS

RELATED APPLICATIONS

This application is a continuation of application Ser. No. 10/143,504, filed on May 10, 2002 now abandoned, that claimed priority from provisional application No. 60/289,867, filed on May 10, 2001, both of which are incorporated herein by reference.

BACKGROUND

1. Technical Field

This invention relates to a device that controls the air input to the fuel/air circuit of a carburetor for an internal combustion engine.

2. Background

Carburetors are devices that make and control the quantity and ratio of a fuel/fair mixture fed to a spark-ignition internal combustion engine. Carburetors generally have a tube called a throat or barrel that is attached to a manifold that supplies one or more engine cylinders. A single or multi-barrel carburetor can feed several cylinders through a manifold or one carburetor can be provided for each cylinder.

The overall volume of fuel/air mixture is controlled by a throttle located in the throat of the carburetor. This can be a butterfly or slide valve. Within the carburetor adjacent to the throat, are interconnected fuel and air passages. These may be arranged in one or more groupings of passages called circuits that eventually discharge fuel/air mixtures into the throat. For example, an idle circuit may discharge a mixture into the throat between the cylinders and the throttle. When the throttle is substantially closed, this circuit controls the idle speed of the engine. A main circuit may discharge into the throat on the other side of the throttle. When the throttle is open, this circuit controls the engine speed and power.

These circuits have a passage connecting the throat to a fuel reservoir fed from a fuel tank through a metering valve. The passage usually passes through a region, sometimes called an emulsion tube, having small holes that are connected through other passages to ambient air. The connection to ambient air, sometimes called an air bleed, is to produce an emulsion of fuel and air, i.e., to aerate the fuel. Aerated fuel is advantageous because it has a lower viscosity flowing into the carburetor throat and vaporizes more readily on the way to the cylinders.

The amount of aeration depends, in part, on the size of the air bleed passage. Often, there is a small orifice or restriction that limits the air flow. Since air flow will depend on air pressure, temperature, and humidity, the size of the restriction is usually a compromise. Sometimes, these restrictions are replaceable with different sizes to compensate, for example, for high altitude operation.

There have been a number of patents related to controlling the air through an air bleed using devices added to conventional carburetors. Typically, they use a variety of sensors and schemes to optimize engine performance by varying the air flow. Starting in about 1980, passenger autos started to use direct fuel injection instead of conventional carburetors and this changeover was complete by about 1990.

Lacking emission control requirements, motorcycle engines, by and large, still do not use fuel injection. Motorcycle carburetors generally use slide valves and have the two fuel/air circuits discussed above plus a pilot circuit that is most effective between idle and about three eights wide-open throttle. When the air input ports to these three circuits is inside the barrel, they are termed air bleeds. They bleed a very small amount of air from the air going down the barrel. When the air intake ports are outside the barrel, they are termed air jets, but the terminology is often interchanged. Herein, air bleed or air jet refers to whatever air intake port provides air to emulsify the fuel. (Motorcycle carburetors also have their barrels extended by demountable tubes termed velocity stacks.)

Currently, most motorcycle engines are 4 cylinder in-line configurations with a single carburetor dedicated to each cylinder. A few are V-4s, again with a carburetor per cylinder and some are V-2 twins with a single carburetor and a manifold.

Even the one carburetor per cylinder layout comes with a wide variety of design detail. Some have replaceable air bleeds while others have a fixed air bleed tube diameter. Unfortunately, none have easily adjustable air bleeds. This makes it difficult to tune this part of the carburetor for best performance under a variety of conditions. Even if available, having more that one carburetor on an engine makes balancing adjustments extremely difficult.

For a long time, it has been known that controlling the air bleed in a carburetor could improve engine performance. U.S. Pat. No. 4,320,731, issued Mar. 23, 1982 to Braun et al., discloses a free standing air bleed control module for an automobile downdraft-type carburetor. On the particular carburetor illustrated, this module can apparently be installed without any modifications other than affixing an air tube. However, there is no provision for a multi-carburetor setup and it requires an electronic control unit. Although the unit is stated to be of conventional design, it might be impractical for a motorcycle, at least as an add-on to an existing carburetion system.

There are a number of non-electronic after-market kits designed to improve motorcycle engine performance. Carburetor kits are available with different size air bleed orifices or jets, needle valves, venturis and the like. Unfortunately, these are not readily adjustable to optimize performance as much as possible or for changing conditions. Engine performance can also be boosted somewhat with after-market exhaust/muffler systems. Unfortunately, these are relatively expensive. Before this invention, there has been no effective, yet practical and economical device for optimizing carburetor and hence engine performance under varying conditions.

SUMMARY

Accordingly, the main objective of the invention is to provide a simple control device for a carburetor with a fuel/air circuit having an air bleed input. The device should be relatively economical, easy to install and manually adjustable. In engines with more than one carburetor, the device should provide substantially equal air flow to all carburetors with a single simultaneous adjustment. In engines with carburetors having more than one fuel/air circuit, the device could provide separate adjustments for each of the selected functionally separate fuel/air circuits, but simultaneous adjustment for all the carburetors. The device is designed for motorcycle engines, but should be useful in race cars and the like having similar setups.

An additional optional objective is to modulate the air flow into the device and to the carburetors by locating the source of air into the device in different air stream environments; quiescent, pointed into an air stream, and away from one. Another optional objective is to provide a remote control.

These objectives are realized by a device having an air distribution block having at least one air input port and a sufficient number of air valves and air output ports for the particular engine. For a single carburetor with a single selected air bleed, one valve and one air output are required. For multiple carburetors, each with one selected air bleed, one valve and a number of air output ports equal to the number of carburetors are required. Substantially equal air flow to multiple carburetors can be enhanced by utilizing a chamber to balance flow to the air outputs and a symmetrical layout for them. For a single carburetor with two selected air bleeds, two valves separately connected to two air outputs are required. Lastly, for an engine with multiple carburetors each having two selected fuel/air circuits with air bleeds, two valves, each separately connected to an air output for each carburetor, are required. Sufficient air tubing is required to connect the air outputs to the carburetor air bleeds.

Optionally, an additional air tube may provided so that the source of air for the air distribution block input or inputs may be located in selected locations, for example, in a carburetor air stream. Another option is to provide a remote control from, for example, the handlebars of a motorcycle.

DETAILED DESCRIPTION

Figure 1:
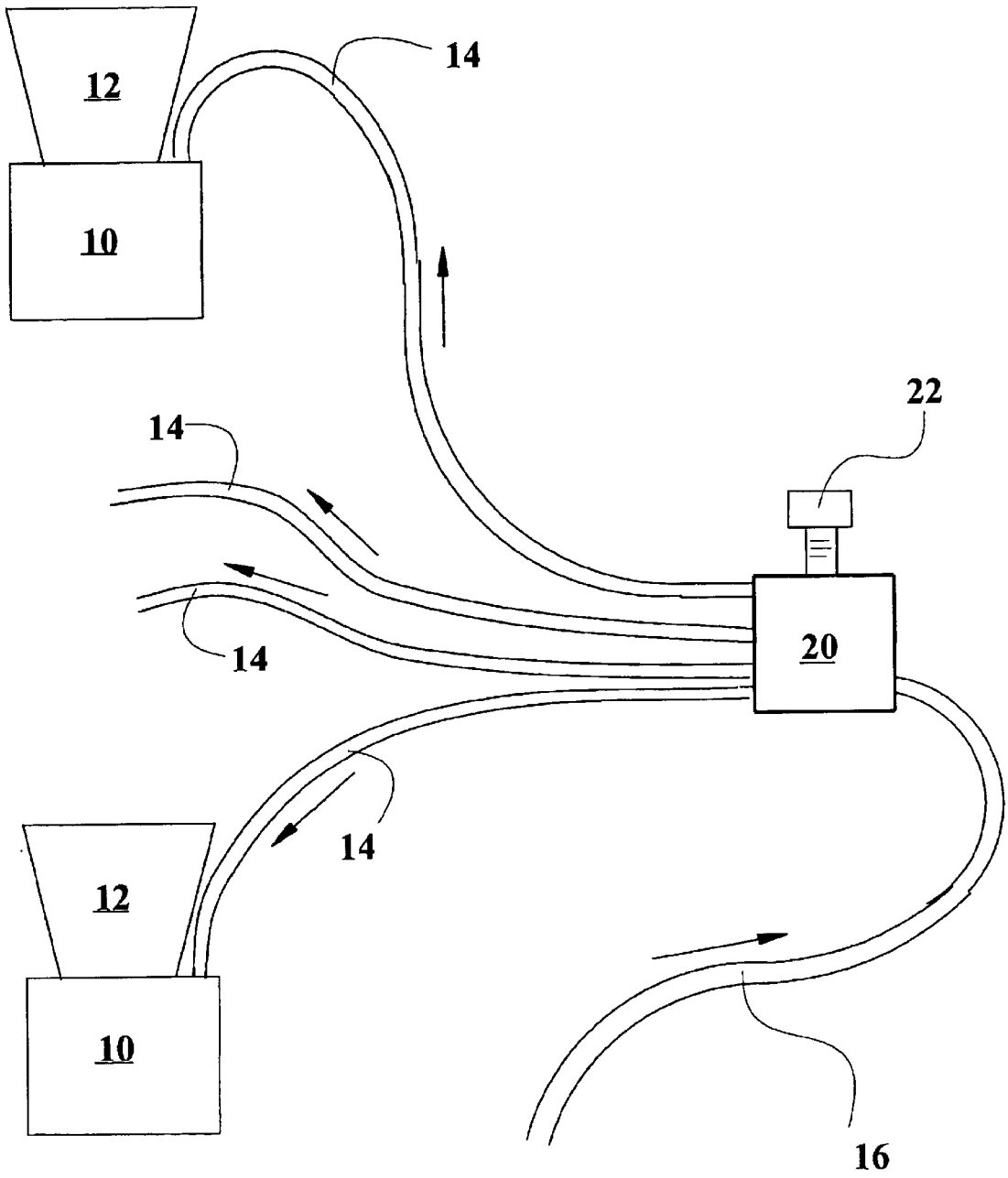
FIG. 1 illustrates the invention connected to one or more carburetors.

FIG. 1 illustrates an overview of one working embodiment of the invention. One or more carburetors 10 having velocity stacks 12 are each connected to output air tubes 14 that are, in turn, connected to a distribution block 20. An intake air tube 16 connects to block 20 on one end and to ambient air on the other. The distribution block has an internal valve 22 disposed between the intake and output tubes that is manually adjusted with the illustrated knob. Valve 22 controls the amount of air passing between the intake tube 16 and out put tubes 14.

Figure 2A:
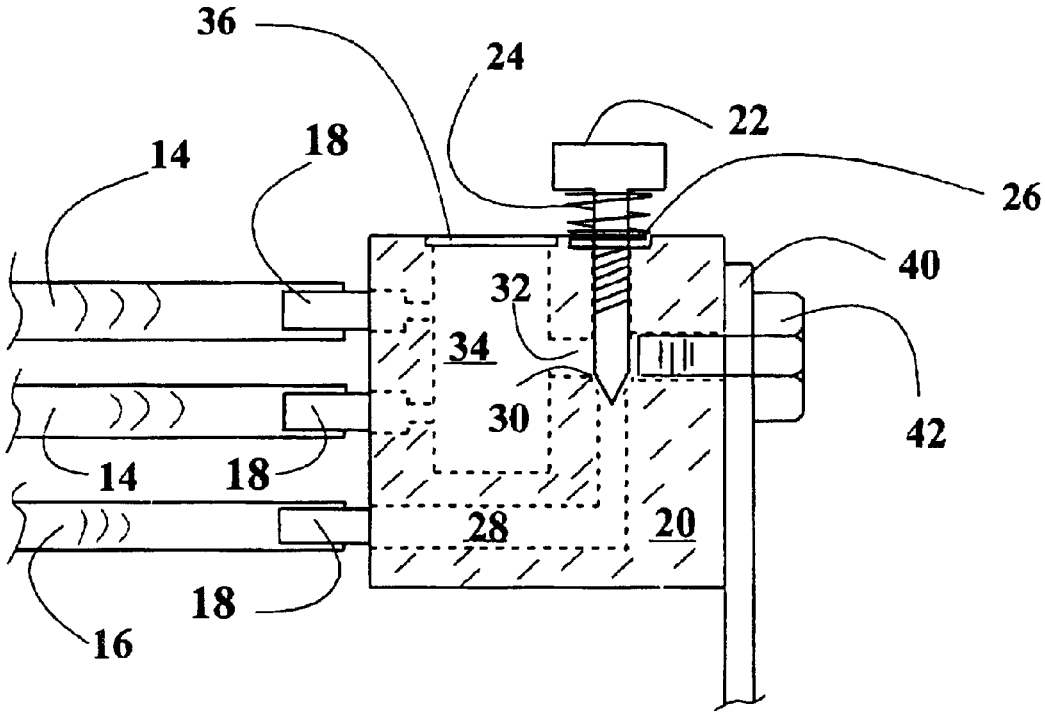
FIG. 2*a* shows a cross-section of a distribution block used in working examples.

FIG. 2*a* shows a schematic of the internal cross section of the distribution block 20. The air intake tube 16 is mounted on block tubing adapter 18 that is mounted at the end of intake passage 28 that leads to the valve 22 (illustrated as a needle valve type) having a circumferential seat area 30. When valve 22 is not completely closed, air may be sucked through valve passage 32 into a balance chamber 34. Output air tubes 14 are mounted on block tubing adapters 18 that connect to the balance chamber 34.

For illustrative purposes, the drawing shows only two output air tubes arranged perpendicularly to a centerline of block 20. They are purposefully arranged symmetrically with respect to the output of the valve passage 32. In the working example, the balance chamber 34 and the valve passage 32 are borings. The balance chamber is closed off with a press fit cap 36. The outer part of the valve passage is threaded and can be closed off with a machine screw 42 that attaches a mounting bracket 40. A spring 24 and rubber o-ring 26 help keep the needle valve from rotating due to engine vibrations.

Figure 2B:
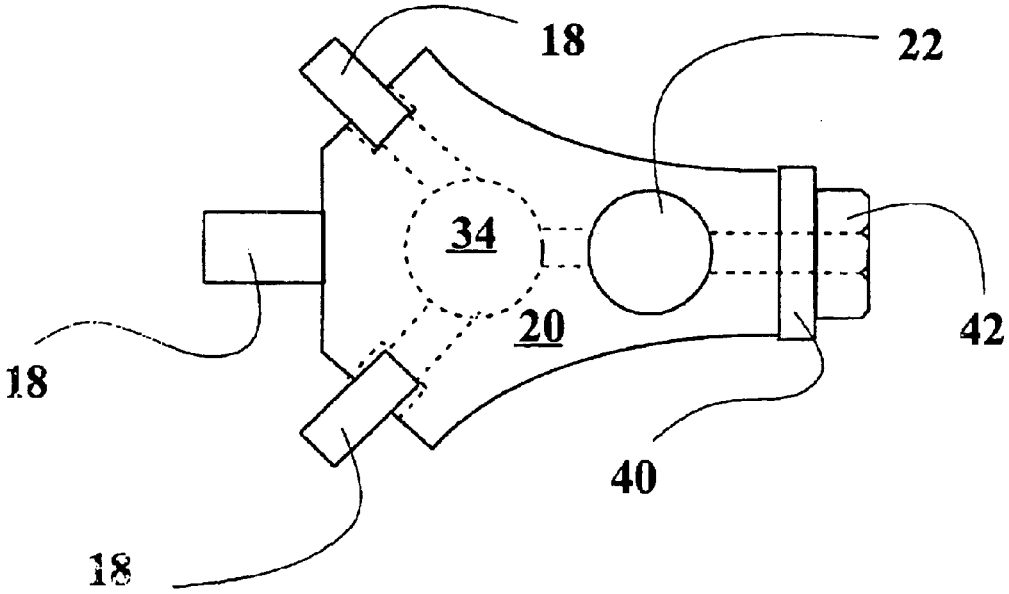
FIG. 2*b* shows a top view of the distribution block shown in FIG. 2*a;*

FIG. 2*b* is a top view of distribution block 20 having four output air tube adapters 18 (the top two are shown) arranged in two pairs off-angle from the block centerline. In this illustration, the input air tube adapter 18 is the one on the centerline. The curved external shape of block 20 is aesthetic only.

It is desirable, if there is substantially equal air flow into all output air tubes 14. This is aided by arranging the location of the air tubes to be symmetrical with respect to the input of the valve passage 32 into the balance chamber 30. Also, the length of the air tubes is kept the same wherever practical. In addition, if the restriction due to the block 20 is large compared to the restriction due to the air tubes 14 and downstream restrictions, then the air flow will be evened out. In practice, this should be relatively easy to obtain. In the working examples described further herein below, the air tubes are nylon (Nylotube, a Registered Trademark of New Age Industries, Willow Grove, Pa.) 3/16 in. ID and, typically, 6–8 in. long. The block tube adapters 18 are 1/8 in. ID and about 1/2 in. long. The balance chamber is about 0.312 in. ID and 3/4 in. long. The seat area 30 has a mean diameter of about 9/64 in. and a vertical height of 0.075 in. The seat dimensions only affect the sensitivity of the valve.

Figure 3:
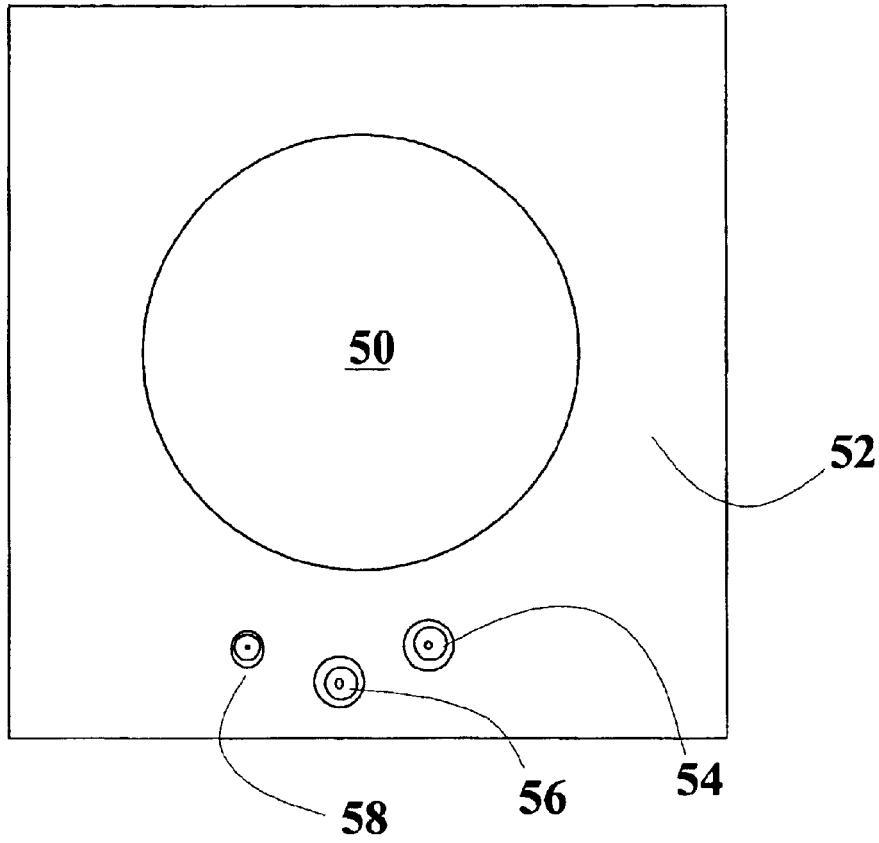
FIG. 3 shows the location of air bleeds in an example carburetor.

FIG. 3 illustrates a view looking into the throat 50 of a motorcycle carburetor from the top. The body 52 surrounding the throat is illustrated as having a main air jet 54, a pilot air jet 56, and an idle air jet 58. In practice, there are many makes and models that all look slightly different. However, the stock, as-sold, air inputs can always be determined from manufacturer's specifications.

Figure 4:
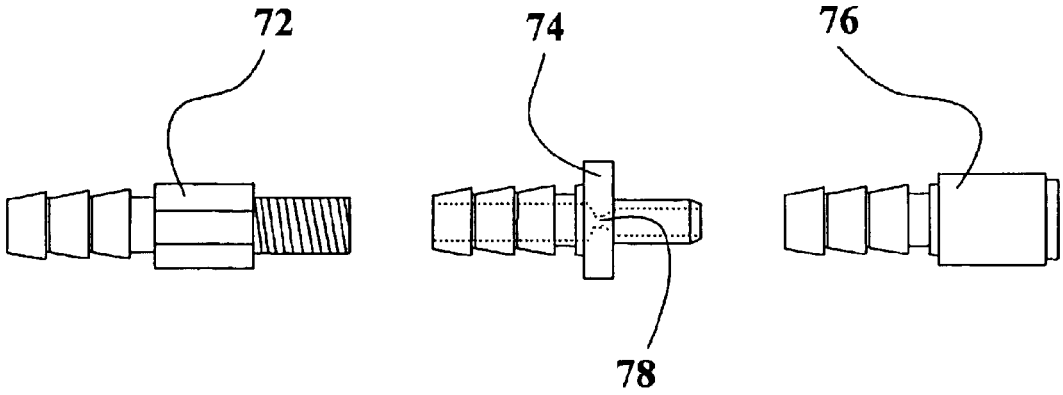
FIG. 4 illustrates various tubing adapters.

Each carburetor air input port requires some modification to connect an air tube. FIG. 4 illustrates three different versions of carburetor tubing adapters, 72, 74, and 76 that cover most models. Some carburetors have air jets or bleeds with screwed in restrictions. For those, the existing restriction may be unscrewed and the adapter 72 screwed in to replace it. Others have a restrictor integral to or press fit into a passage. Those must be pulled and/or bored out. Adapter 74 can be used as a press fitting in that instance. This adapter is shown with a boring having a restriction 78. The size of the restriction will vary from carburetor to carburetor. The goal is to match the restriction of what was removed, but not make it more restrictive. If it is more restrictive, then, even with the valve 22 wide open, it would not be possible to include the air bleed range of the original carburetor in the range of possible settings.

Adapter 76 is convenient for the few carburetors that have short tubular protrusions around the air bleed inputs. It can be press fit around the OD of those. Unlike adapters 72 and 74, it does not have an internal restriction, because the one in the carburetor is not replaced. It might seem that, in this case, installation of the invention would necessarily make the fuel/air mixture always richer than without the invention. However, it has been found that the simple effect of adding the tubing is to increase the air flow. This, with the valve 22 wide open, it is possible to cover the range of the original setting.

A typical kit supplied to a motorcycle owner for self installation includes, at a minimum, a distribution block 20 with mounted valve 22 and about 4 feet of air tubing. For convenience, a mounting bracket 42 with associated hardware (an air jet removal tool, comprising a sized drill bit or counter-clockwise fluted extractor depending on the carburetor; an air tubing installation tool; additional tubing for the air input; and a tie wrap) can be included. The tie wrap is to locate the air input tubing in a selected location.

Installation of the invention on a motorcycle is fairly straightforward and requires only common tools in addition to those supplied. The basic steps are: 1) remove gas tank and air box to gain access to the carburetors, 2) remove air bleeds/jets as needed, 3) install carburetor tubing adapters, 4) mount the distribution block in a convenient location, 5) cut tubing to length, 6) push tubing onto the adapters on the carburetors and distribution block, 7) use the tie wrap to locate the input air tube in a location where air is not turbulent, 8) replace air box and gas tank, and 8) adjust valve 22. For some carburetors, it will be necessary to cut out a slot in the velocity stacks for the air tubing to pass through. In other cases, this will be convenient to locate the air tubes. In still others, sleeves that protect the air tubes may be desirable.

It is thought that it should be possible to increase or decrease air into the input tubes 16 as a function of rpm by orienting the input in the air stream between the air filter and the carburetors. This would make it possible to make the mixture leaner or richer as the rpm increased and may improve some engines. In other cases, pointing the input air tube downstream would produce the reverse effect or it may be preferable to locate it in a volume of non-moving air.

It is necessary to experiment with needle valve 22 settings to achieve optimum performance. However, for the dimensions of the working example and the restrictors as described above, about 3½ turns out from fully closed was found to leave the stock air/fuel ratio substantially unaltered. Even so, when installed with four carburetors, there is some improvement because the air intake to each is better balanced. It was found that installation of a slip on muffler required about one turn in, restricting the air slightly, to restore the mixture. Also, a more efficient after-market air filter requires an additional ½ to 1 turn more restriction.

While it is possible to optimized adjustment of the needle valve based on how smoothly the engine revs up from idle and/or accelerates, a dynamometer is required to maximize torque and/or horsepower over a range of engine rpm. Results will not only depend on the engine and fuel used, but the ambient conditions, mainly altitude, and also temperature and humidity to some extent. FIGS. 5 through 8 show results with and without the invention used with four different types of carburetors installed on four cylinder motorcycles. Significant increases are possible in both available horsepower and torque at most rpms. In addition, the output curves are smoother which makes throttle response easier to control. (Note that torques start out higher than horsepower on all the graphs and cross over at about 5,000 rpm. This 5,000 rpm crossover is an artifact based on the selection of a vertical scale for numerical values for horsepower and torque in ft-lbs. which here are the same.)

Figure 5:
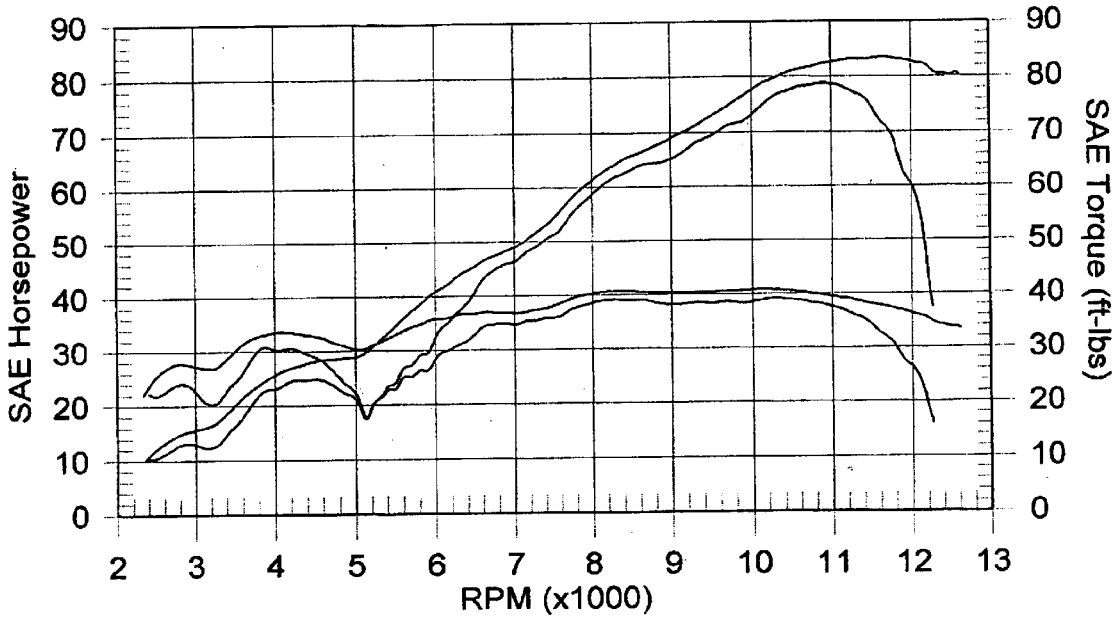
FIG. 5 is a graph showing the improvement in horsepower and torque using the invention with Keihin carburetors mounted on a Honda CBR F2 motorcycle.

FIG. 5 is for Keihin carburetors installed on a Honda CBR F-2 motorcycle and is the most dramatic. Two curves are shown for horsepower and torque. The upper curves are with the inventions adjusted to near optimum (about 3½ turns out) and the lower curves are without. Coincidently, without the invention, horsepower and torque show a pronounced dip at about 5100 rpm. There, the numerical values of each drop from about 30 to 18 (40%). With the invention installed, the dip is not nearly as pronounced: no actual dip in horsepower and only about 10% in torque. The high end performance beyond 11,000 rpm is also significantly improved. An improvement of a few horsepower in the mid-range might not seem significant, but this kind of improvement usually requires the expense of, for example, an after-market tuned exhaust system, including pipes and mufflers. Moreover, such a system is not re-tunable for different conditions. The lower curves were obtained with an aftermarket jet kit installed. It is believed that the installation was correct, but the invention clearly improved on that.

Figure 6:
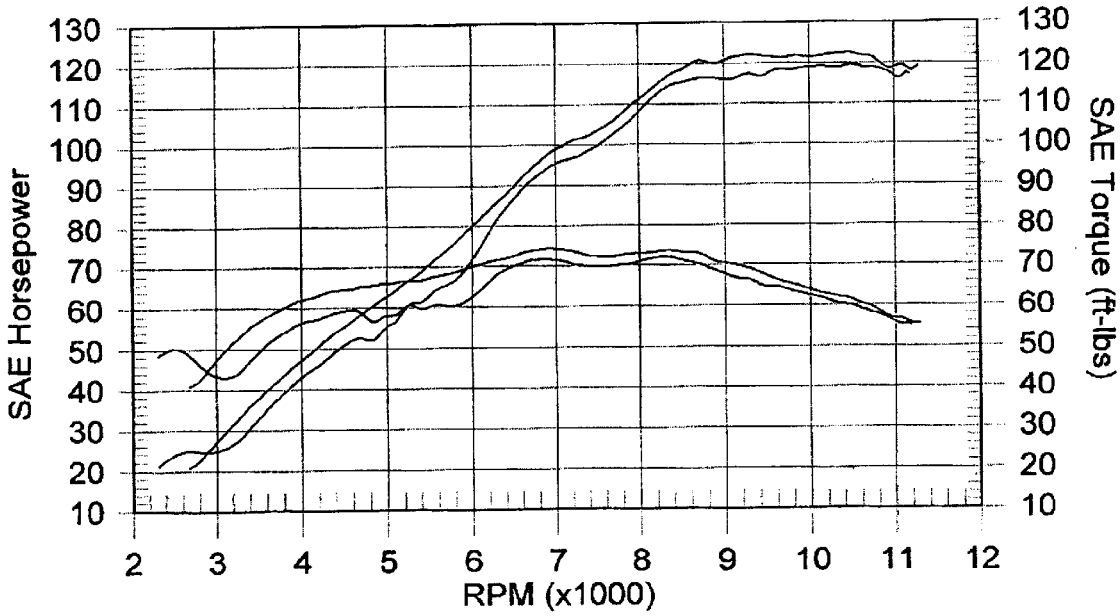
FIG. 6 is a graph showing the same on a Kawasaki ZX11 motorcycle.

FIG. 6 is for a Kawasaki ZX11D motorcycle, also with Keihin carburetors. For this one, power and torque curves can be significantly straightened out with no dips in either at 5,000 rpm. In this case, the optimum setting was 1¼ turns out, a fairly rich mixture. Typically, as this case illustrates, the range of about 4,500 to 6,500 rpm is where there is a transition as the source of air/fuel mixture changes from the pilot to the main circuits. One of the aims of the invention is to smooth out this transition where possible.

Figure 7:
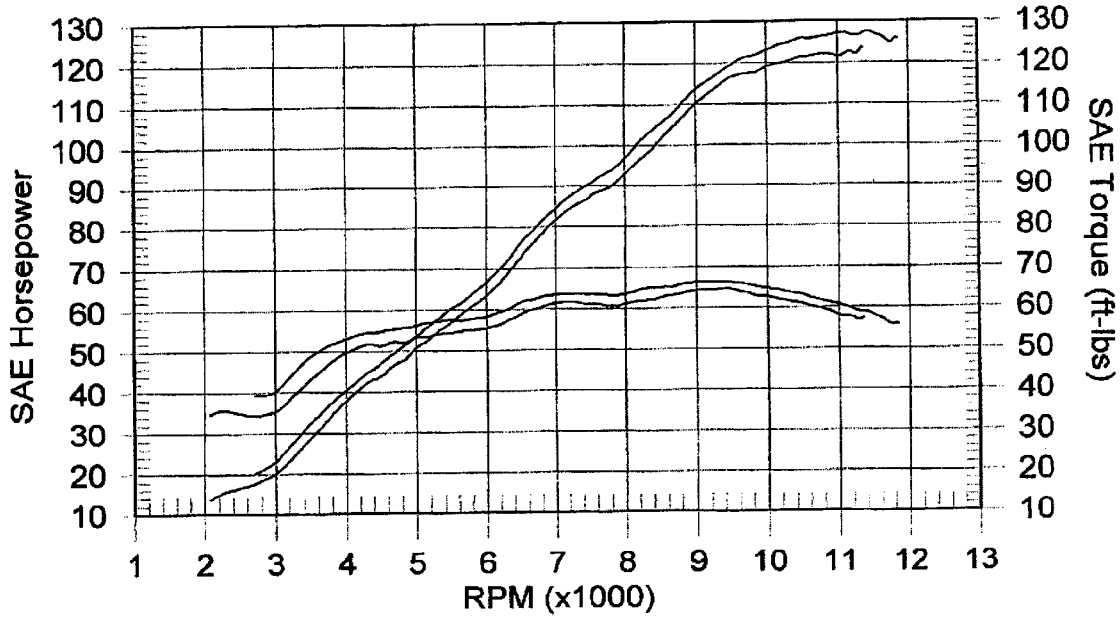
FIG. 7 is a graph showing the same on a Kawasaki ZX9-R motorcycle.
Figure 8:
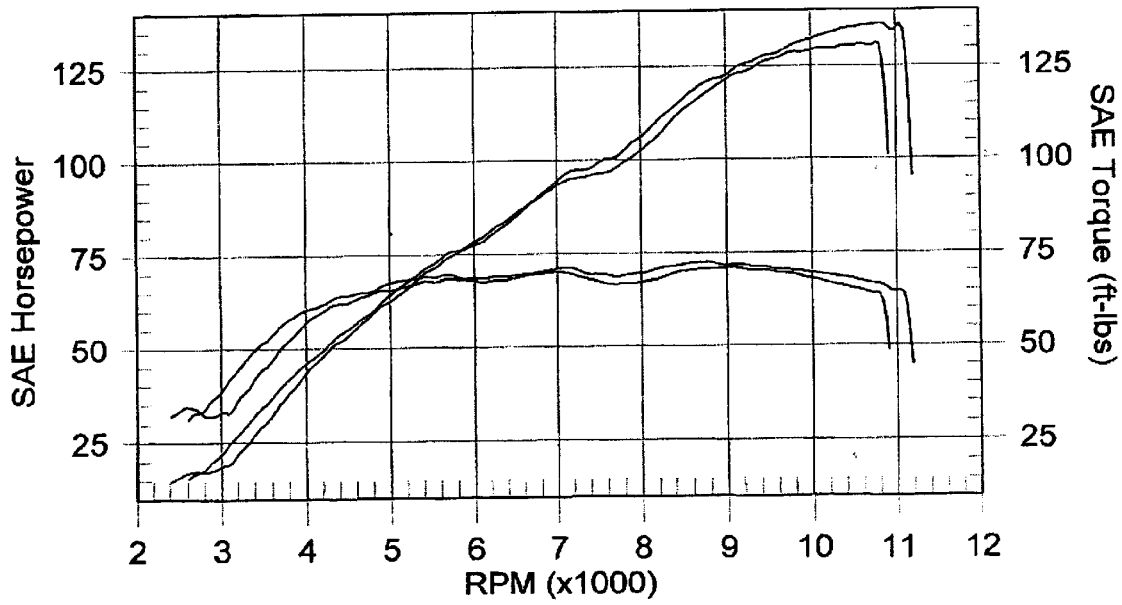
FIG. 8 is a graph showing the same with Mikuni carburetors mounted on a Yamaha R-1 motorcycle.

FIG. 7 show results for Keihin carburetors installed on a Kawasaki ZX9-R motorcycle. Here the main improvement is a boost in horsepower and torque at all rpms. FIG. 8 shows results for Mikuni carburetors installed on a Yamaha R-1 motorcycle. In this case, there is significant improvement in horsepower and torque at both the low and high rpm ranges.

Having described one embodiment of the invention as installed on a variety of motorcycles, it should be obvious that the same principles of the invention can be utilized in a number of ways. First, it may be convenient to operate the valve 22 from the handlebars or other remote location. U.S. Pat. No. 5,762,158, issued Jun. 9, 1998 to Sumner, Jr., incorporated herein by reference, discloses a remote motorcycle idle adjustment control. The same or a similar approach could be used to adjust the valve 22 of this invention. Second, it is not necessary to use all four of the output air lines 14 of the working examples. If the others are blocked off, even one could be used to solve problems with adjusting a single carburetor. Third, applications are not limited to motorcycles. It is unlikely that it could be used with modern passenger autos, but there are some race cars with engine formulas that are similar to the motorcycles engines for with the invention was initially designed. In general, the invention should be useful whenever a similar situation is found. Fourth, the working examples above were only tried on the main air bleed/jet. Since the problems and principles are similar, the invention could be used for both the pilot air bleed/jets and the main ones.

It should be understood that there are a number of obvious equivalents that will occur to those of ordinary skill in this art and it is intended that these are included in the appended claims.

What is claimed is:

1. An internal combustion engine air bleed control device having at least two carburetors which have at least one air/fuel circuit with an air bleed input coupled to each carburetor, said control device comprising:

an air distribution block having an air input port with a tubing adaptor, an intake passage connected at one end to the air input port and having a circumferential seat area at the other end, at least two air output ports each having tubing adaptors, and a needle valve with a spring and rubber o-ring positioned between said air input port and said at least two output ports, said needle valve having a tip which extends into said circumferential seat area;

an air output balance chamber located between said valve and said output ports, a valve passage connecting said circumferential area and said balance chamber, said balance chamber and valve passage comprising borings in said distribution block, said balance chamber having a top closed off with a press fit cap, and said valve passage having an outer part being threaded and closed off with a machine screw attached to a mounting bracket;

at least two air tubes each having one end mounted on respective said tubing adaptors of said at least two output ports and having another end mounted on respective said air bleed inputs;

an intake air tube connected at one end to said tubing adaptor of said air input port and to ambient air at the other end, and said valve having adjusting means for simultaneously controlling air flow into said air bleed inputs of said carburetors.

2. The device of claim 1 wherein said valve is controlled remotely.

3. The device of claim 1 wherein said engine is mounted on a motorcycle.

4. The device of claim 1 wherein:

said engine has at least two said carburetors, each said carburetor having at least two functionally separate said fuel/air circuits having said air bleed inputs;

said air distribution block has a first set of at least two said air output ports, said first set having a first said valve disposed between them and said at least one air input port and said air output balance chamber disposed between said first valve and said first set of output ports; and said air distribution block further has a second set of at least two said air output ports, said second set having a first said valve disposed between them and said at least one air input port; and said air output balance chamber disposed between said second valve and said second set of output ports, whereby said first and second valves can be adjusted to independently control the air flow into said functionally separate air bleed inputs.

5. The device of claim 4 wherein said valve is controlled remotely.

6. The device of claim 4 wherein said engine is mounted on a motorcycle.

* * * * *